US007077764B2

(12) United States Patent
Watanabe et al.

(10) Patent No.: US 7,077,764 B2
(45) **Date of Patent: *Jul. 18, 2006**

(54) GOLF BALL

(75) Inventors: Hideo Watanabe, Chichibu (JP); Hiroyuki Nagasawa, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/823,799

(22) Filed: Apr. 14, 2004

(65) Prior Publication Data

US 2005/0233836 A1 Oct. 20, 2005

(51) Int. Cl.
*A63B 37/12* (2006.01)

(52) U.S. Cl. ..... 473/378

(58) Field of Classification Search ..... 473/378, 473/351, 368, 367

See application file for complete search history.

(56) References Cited

U.S. PATENT DOCUMENTS 5,645,496 A * 7/1997 Endo et al. ..... 473/372
5,695,413 A 12/1997 Yamagishi et al.
5,792,009 A * 8/1998 Maruko ..... 473/359
6,194,505 B1 2/2001 Sone et al.
2002/0183135 A1* 12/2002 Tsunoda et al. ..... 473/332
2003/0125136 A1 7/2003 Iwami et al.
2004/0053710 A1* 3/2004 Lacroix et al. ..... 473/371

FOREIGN PATENT DOCUMENTS

JP 08-294549 A 11/1996
JP 11-035633 A 2/1999
JP 11-164912 A 6/1999
JP 2002-293996 A 10/2002
JP 2003-175128 A 6/2003

* cited by examiner

*Primary Examiner*—Raeann Gorden
(74) *Attorney, Agent, or Firm*—Sughrue Mion, PLLC

(57) ABSTRACT

A golf ball comprising a core and a cover formed of a cover resin composition is characterized in that the core has a hardness corresponding to a compressive deflection amount of at least 3.5 mm when the load applied thereto is increased from an initial load of 10 kgf to a final load of 130 kgf, the cover resin composition has a melt flow rate of at least 3 as measured according to JIS K7210, and the cover has a gage of up to 1.7 mm. The golf ball has a soft feel, offers superior flight performance to even those golf players with a low head speed of 35 m/s or less, and is improved in durability to repeated impact and moldability.

13 Claims, 1 Drawing Sheet

GOLF BALL

BACKGROUND OF THE INVENTION

This invention relates to a golf ball having a soft feel on impact, which offers superior flight performance to even those golf players who swing a driver (W#1) at a low head speed (HS) of 35 m/s or less, and is improved in durability to repeated impact and moldability.

In order for the golf ball to present a soft feel on impact, the core must be made relatively soft. Development works on golf balls have been made not only for high head speeds, but also for low head speeds. For the prior art golf balls intended for low head speeds, a soft feel was obtained at the sacrifice of travel distance. It was difficult to find a good compromise between travel distance and feel.

More specifically, low head speed golf players, who wish to increase the travel distance, tend to use a driver (W#1) having a larger loft angle than high head speed golf players. In this situation, when the ball is hit at a low head speed, the ball launches at a larger angle and receives more spin, which results in a reduction of travel distance. An attempt was thus made to increase the travel distance of the ball by designing a ball structure having a soft core enclosed with a thin cover for thereby minimizing the spin rate of the ball.

For example, JP-A 8-294549 discloses a golf ball comprising a solid core and a cover enclosing the core, characterized in that the core has a hardness corresponding to a deflection amount of at least 3.5 mm under a load of 100 kg and the cover is composed mainly of an ionomer resin and has a Shore D hardness in the range of 50 to 63 and a 300% modulus in the range of 15 to 35 MPa. However, this golf ball does not intend to improve moldability from the standpoint of cover stock flow and fails to provide the satisfactory property of travel distance when hit at low head speeds.

Also, JP-A 2003-175128 discloses a golf ball comprising a cover in which a ternary composite material consisting of rubber, polyolefin and nylon components is admixed with an olefinic resin. In this golf ball, however, the durability to repeated impact of the cover is insufficiently improved.

SUMMARY OF THE INVENTION

The present invention is made under the above-discussed circumstances and its object is to provide a golf ball having a soft feel which offers superior flight performance to even those golf players who swing a driver (W#1) at a low head speed (HS) of 35 m/s or less, and is improved in durability to repeated impact and moldability.

Making extensive investigations to attain the above object on a golf ball having a softened core and a thinned cover, intending to enhance the fluidity of a cover resin composition in order to overcome the problem of molding defects induced during injection molding of the thin cover, and paying attention to the core hardness and the melt flow rate of the cover resin composition in order to prevent any degradation of durability to repeated impact inherent to the thin cover, the inventors have found that a golf ball characterized in that the core has a hardness corresponding to a compressive deflection amount of at least 3.5 mm when the load applied thereto is increased from an initial load of 10 kgf to a final load of 130 kgf, the cover resin composition has a melt flow rate of at least 3 as measured according to JIS K7210, and the cover has a gage of up to 1.7 mm has a soft feel, offers superior flight performance to even those golf players with a low head speed of 35 m/s or less, and is improved in durability to repeated impact and moldability.

The present invention is predicated on this finding. Finding that by adding a binary copolymer consisting of polyolefin and polyamide components to the base resin in the cover, even the cover which is as thin as 1.7 mm or less is significantly improved in durability to repeated impact, the inventors have completed the present invention.

Accordingly, the present invention provides a golf ball as defined below.

[1] A golf ball comprising a core and a cover formed of a cover resin composition, characterized in that said core has a hardness corresponding to a compressive deflection amount lo of at least 3.5 mm when the load applied thereto is increased from an initial load of 10 kgf to a final load of 130 kgf, said cover resin composition has a melt flow rate of at least 3 as measured according to JIS K7210, and said cover has a gage of up to 1.7 mm.

[2] The golf ball of [1], wherein said core has a hardness at its center of 28 to 40 in Shore D hardness and a hardness at its surface of 35 to 52 in Shore D hardness, and the difference in hardness between the core surface and the core center is 3 to 20.

[3] The golf ball of [1], wherein said cover resin composition comprises as a resin component at least one component selected from the group consisting of olefin-unsaturated carboxylic acid copolymers, olefin-unsaturated carboxylic acid-unsaturated carboxylic acid ester copolymers, and metal ion-neutralized products of these copolymers.

[4] The golf ball of [1], wherein said cover resin composition has organic short fibers dispersed and incorporated therein.

[5] The golf ball of [1], wherein said cover resin composition comprises (a) at least one component selected from the group consisting of olefin-unsaturated carboxylic acid copolymers, olefin-unsaturated carboxylic acid-unsaturated carboxylic acid ester copolymers, and metal ion-neutralized products of these copolymers and (b) a binary copolymer consisting of polyolefin and polyamide components in admixture as a resin component.

[6] The golf ball of [5], wherein the polyamide in component (b) is in fiber form.

[7] The golf ball of [5], wherein a weight ratio of (a)/(b) is between 100/0.1 and 100/50.

[8] The golf ball of [5], wherein in component (b), a weight ratio of polyolefin/polyamide components is between 25/75 and 95/5.

DETAILED DESCRIPTION OF THE INVENTION

Figure 1:
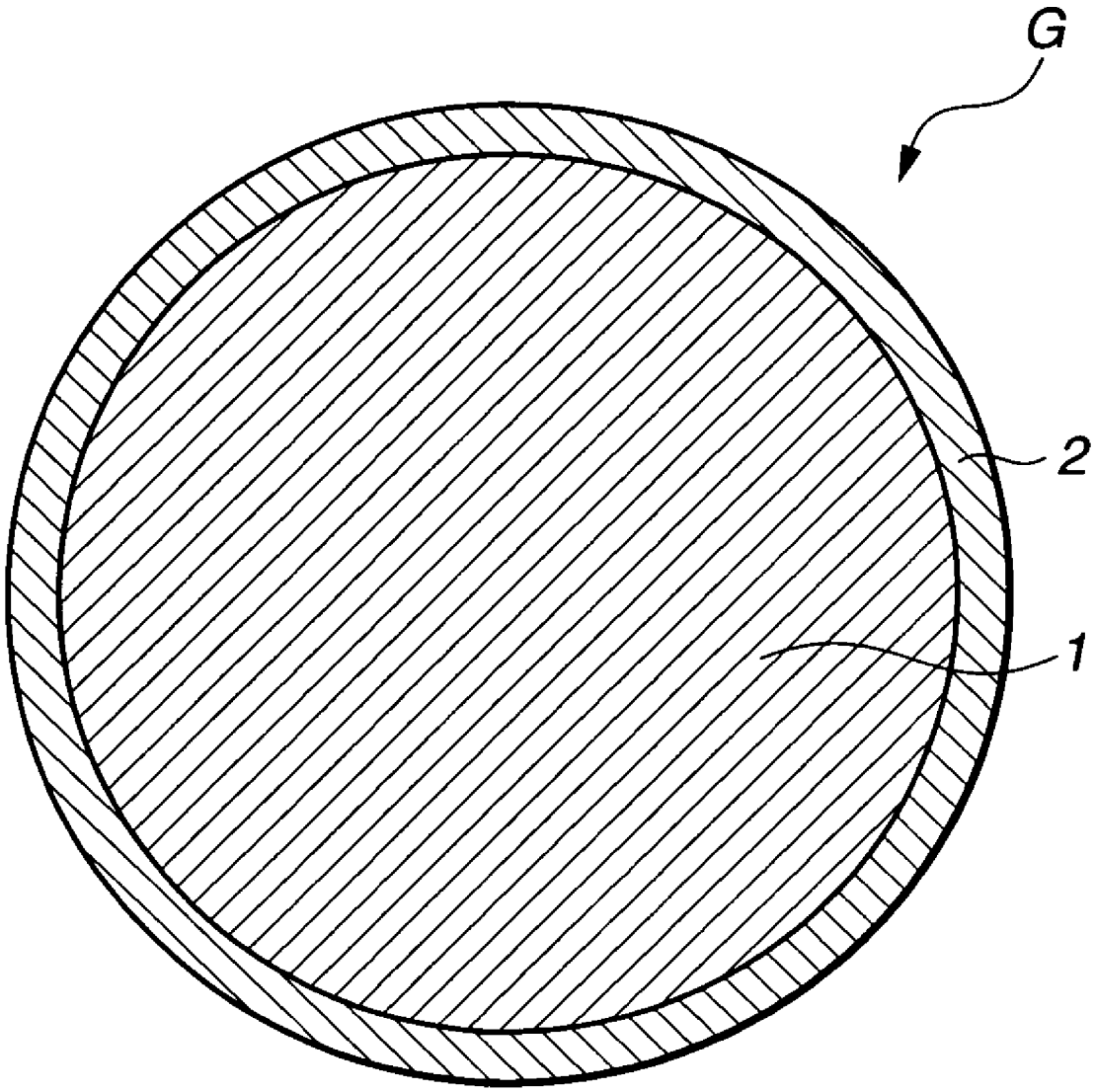
FIG. 1 is a schematic cross-sectional view of a golf ball in one embodiment of the invention.

Now the invention is described in detail.

The golf ball of the invention having a core and a cover is embodied, for example, as a ball structure G consisting of a single layer core 1 and a single layer cover 2 as shown in FIG. 1.

The solid core may be formed of a rubber composition containing, for example, a co-crosslinking agent, an organic peroxide, an inert filler, an organosulfur compound and the like. The base rubber used in the rubber composition is preferably polybutadiene.

The polybutadiene as the rubber component preferably has a cis-1,4 unit content on the polymer chain of at least 60 wt %, more preferably at least 80 wt %, even more preferably at least 90 wt %, and most preferably at least 95 wt %. A polybutadiene having too low a cis-1,4 unit content in the molecule may lower the resilience.

Moreover, the polybutadiene has a 1,2-vinyl unit content on the polymer chain of generally not more than 2%, preferably not more than 1.7%, and even more preferably not more than 1.5%. Too high a 1,2-vinyl unit content may lower the resilience.

To obtain a molded and vulcanized rubber composition of good resilience, the polybutadiene used herein is preferably synthesized with a rare-earth catalyst or a Group VIII metal compound catalyst. Polybutadiene synthesized with a rare-earth catalyst is especially preferred.

Such rare-earth catalysts are not subject to any particular limitation. Exemplary rare-earth catalysts include those made up of a combination of a lanthanide series rare-earth compound with an organoaluminum compound, an alumoxane, a halogen-bearing compound and an optional Lewis base.

Examples of suitable lanthanide series rare-earth compounds include halides, carboxylates, alcoholates, thioalcoholates and amides of atomic number 57 to 71 metals.

In the invention, the use of a neodymium catalyst in which a neodymium compound serves as the lanthanide series rare-earth compound is advantageous because it enables a polybutadiene rubber having a high cis-1,4 unit content and a low 1,2-vinyl unit content to be obtained at an excellent polymerization activity. Preferred illustrative examples of such rare-earth catalysts include those mentioned in JP-A 11-35633, JP-A 11-164912 and JP-A 2002-293996.

In the rubber component, the polybutadiene synthesized using the lanthanide series rare-earth compound based catalyst is preferably contained in an amount of at least 10 wt %, more preferably at least 20 wt %, and most preferably at least 40 wt %, for improving resilience.

Rubber components other than the above-described polybutadiene may be included in the base rubber, insofar as the objects of the invention are not compromised. Examples of such additional rubber components other than the above-described polybutadiene include polybutadienes other than the above-described polybutadiene, and other diene rubbers, such as styrene-butadiene rubbers, natural rubbers, isoprene rubbers and ethylene-propylene-diene rubbers.

Examples of the co-crosslinking agent include unsaturated carboxylic acids and metal salts of unsaturated carboxylic acids.

Examples of unsaturated carboxylic acids include acrylic acid, methacrylic acid, maleic acid and fumaric acid. Inter alia, acrylic acid and methacrylic acid are preferred.

The metal salts of unsaturated carboxylic acids include, but are not limited to, the above-described unsaturated fatty acids neutralized with desired metal ions. Illustrative are zinc and magnesium salts of methacrylic and acrylic acids. Inter alia, zinc acrylate is most preferred.

The unsaturated carboxylic acid and/or metal salt thereof is generally incorporated in an amount per 100 parts by weight of the base rubber of at least 10 parts by weight, preferably at least 15 parts by weight, more preferably at least 20 parts by weight, and as an upper limit, up to 60 parts by weight, preferably up to 50 parts by weight, more preferably up to 45 parts by weight, most preferably up to 40 parts by weight. Too large an amount may result in too high a hardness and an unacceptable feel on impact whereas too small an amount may lead to a decline of resilience.

Commercial products may be used as the organic peroxide. For example, Percumil D (by NOF Corporation), Perhexa 3M (by NOF Corporation) and Luperco 231XL (by Atochem Co.) may be advantageously used. These peroxides may be used alone or in admixture.

The organic peroxide is generally incorporated in an amount per 100 parts by weight of the base rubber of at least 0.1 part by weight, preferably at least 0.3 part by weight, more preferably at least 0.5 part by weight, most preferably at least 0.7 part by weight, and as an upper limit, up to 5 parts by weight, preferably up to 4 parts by weight, more preferably up to 3 parts by weight, most preferably up to 2 parts by weight. Too large or too small an amount may fail to provide a satisfactory feel, durability and resilience.

Examples of the inert filler used include zinc oxide, barium sulfate and calcium carbonate. They may be used alone or in admixture.

The inert filler is generally incorporated in an amount per 100 parts by weight of the base rubber of at least 1 part by weight, preferably at least 5 parts by weight, and as an upper limit, up to 50 parts by weight, preferably up to 40 parts by weight, more preferably up to 30 parts by weight, most preferably up to 20 parts by weight. Too large or too small an amount may fail to provide an adequate weight and a satisfactory resilience.

If necessary, an antioxidant may be incorporated. Commercially available antioxidants are, for example, Nocrac NS-6 and NS-30 (by Ouchi Shinko Chemical Industry Co., Ltd.), and Yoshinox 425 (by Yoshitomi Pharmaceutical Industries, Ltd.). They-may be used alone or in admixture.

The antioxidant is generally incorporated in an amount per 100 parts by weight of the base rubber of at least 0 part by weight, preferably at least 0.05 part by weight, more preferably at least 0.1 part by weight, most preferably at least 0.2 part by weight, and as an upper limit, up to 3 parts by weight, preferably up to 2 parts by weight, more preferably up to 1 part by weight, most preferably up to 0.5 part by weight. Too large or too small an amount may fail to provide a satisfactory resilience and durability.

In the core, an organosulfur compound is preferably incorporated in order to improve the rebound and increase the initial velocity of the golf ball.

The organosulfur compound is not particularly limited as long as it can improve the rebound of the golf ball. Exemplary organosulfur compounds include thiophenols, thionaphthols, halogenated thiophenols, and metal salts thereof. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol; diphenylpolysulfides, dibenzylpolysulfides, dibenzoylpolysulfides, dibenzothiazoylpolysulfides and dithiobenzoylpolysulfides having 2 to 4 sulfurs. Inter alia, the zinc salt of pentachlorothiophenol and diphenyldisulfide are preferred.

The organosulfur compound is generally incorporated in an amount per 100 parts by weight of the base rubber of at least 0.05 part by weight, preferably at least 0.1 part by weight, and as an upper limit, up to 5 parts by weight, preferably up to 4 parts by weight, more preferably up to 3 parts by weight, most preferably up to 2.5 parts by weight. If the addition amount is too large, its effect may plateau, with no further effect being ascertained. With too small an amount, the addition effect may not be fully exerted.

Preferably the core has a diameter of usually at least 39.3 mm, especially at least 39.5 mm, and as an upper limit, usually up to 40.7 mm, especially up to 40.1 mm. The weight is usually 35 to 39 grams, preferably 37 to 38 grams.

Within the above-defined diameter range, the core used herein should have a compressive deflection amount, when the load applied thereto is increased from an initial load of 10 kgf to a final load of 130 kgf, of at least 3.5 mm, preferably at least 4.0 mm, more preferably at least 4.3 mm, and up to 6.0 mm, preferably up to 5.0 mm, more preferably up to 4.7 mm, the deflection amount being referred to as hardness (10–130 kgf). Too small a deflection amount leads to an unpleasant feel on impact. Inversely, with too large a deflection amount, crack durability to repeated impact is worsened and too low resilience fails to provide a travel distance.

The core used herein has a surface hardness of 35 to 52, preferably 37 to 50, more preferably 40 to 48 in Shore D hardness. Also the core has a center hardness of 28 to 40, preferably 30 to 39, more preferably 32 to 38 in Shore D hardness. It is noted that the Shore D hardness is a measurement by a Type D durometer according to ASTM D 2240. If the above hardness is too high, the feel on impact may sometimes become too hard. If the hardness is too low, the feel on impact may sometimes become too soft.

In the practice of the invention, the core surface hardness minus the core center hardness is 3 to 20, preferably 4 to 16, more preferably 5 to 12 Shore D hardness units. If the hardness difference is too large, durability to repeated impact may be worsened and low resilience fail to provide a travel distance. If the hardness difference is too small, the spin rate when hit with a driver (W#1) may be increased, with a resultant failure to provide a travel distance.

For the cover used herein, the cover resin composition should have a melt flow rate of at least 3 as measured according to JIS K7210, and the cover have a gage of up to 1.7 mm.

As the cover resin composition, any well-known synthetic resin may be used without a particular limitation. Preferably the cover is formed of a resin composition comprising as essential components:

(a) a component selected from among olefin-unsaturated carboxylic acid copolymers, olefin-unsaturated carboxylic acid-unsaturated carboxylic acid ester copolymers, and metal ion-neutralized products of these copolymers and (b) a binary copolymer consisting of polyolefin and polyamide components.

Component (a) is selected from among olefin-unsaturated carboxylic acid binary random copolymers, metal ion-neutralized products of olefin-unsaturated carboxylic acid binary random copolymers, olefin-unsaturated carboxylic acid-unsaturated carboxylic acid ester ternary random copolymers, and metal-ion-neutralized products of olefin-unsaturated carboxylic acid-unsaturated carboxylic acid ester ternary random copolymers. The olefins in the copolymers are preferably those having at least 2 carbon atoms, but not more than 8, and especially not more than 6 carbon atoms. Specific examples include ethylene, propylene, butene, pentene, hexene, heptene and octene. Ethylene is especially preferred.

The unsaturated carboxylic acid is exemplified by acrylic acid, methacrylic acid, maleic acid and fumaric acid. Acrylic acid and methacrylic acid are especially preferred.

The unsaturated carboxylic acid esters are preferably lower alkyl esters of the foregoing unsaturated carboxylic acids. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) are especially preferred.

The olefin-unsaturated carboxylic acid binary random copolymers and olefin-unsaturated carboxylic acid-unsaturated carboxylic acid ester ternary random copolymers serving as component (a) herein can be obtained by adjusting the above-described materials and effecting random copolymerization by a well-known method.

It is recommended that the random copolymer have a controlled content of unsaturated carboxylic acid (acid content). It is recommended that the unsaturated carboxylic acid content within the random copolymer serving as component (a) be generally at least 4 wt %, preferably at least 6 wt %, more preferably at least 8 wt %, and most preferably at least 10 wt %, and as an upper limit, generally not more than 30 wt %, preferably not more than 20 wt %, more preferably not more than 18 wt %, and most preferably not more than 15 wt %.

The metal ion-neutralized products of olefin-unsaturated carboxylic acid binary random copolymers and metal ion-neutralized products of olefin-unsaturated carboxylic acid-unsaturated carboxylic acid ester ternary random copolymers serving as component (a) (the metal ion-neutralized products of these copolymers are collectively referred to as metal ion-neutralized products of random copolymers) can be obtained by partially neutralizing acid groups on the random copolymer with metal ions.

Illustrative examples of metal ions for neutralizing the acid groups include $Na^+$, $K^+$, $Li^+$, $Zn^{2+}$, $Cu^{2+}$, $Mg^{2+}$, $Ca^{2+}$, $Co^{2+}$, $Ni^{2+}$ and $Pb^{2+}$. Preferred metal ions include $Na^+$, $Li^+$, $Zn^{2+}$, and $Mg^{2+}$, with $Zn^{2+}$ being especially preferred.

In producing the metal ion-neutralized products of random copolymers, the random copolymers may be neutralized with the metal ions. For example, a neutralizing method using suitable compounds of the metal ions, such as formates, acetates, nitrates, carbonates, hydrogencarbonates, oxides, hydroxides and alkoxides may be employed. The degree of neutralization of the random copolymer with the metal ions is not particularly limited.

Of the metal ion-neutralized products of random copolymers used herein, zinc ion-neutralized ionomer resins are preferred because they are effective for increasing the melt flow rate of the material for adjusting to an optimum melt flow rate to be described later, and improving moldability.

Commercial products may be used as component (a). Specifically, commercial products of the binary random copolymer include Nucrel 1560, 1214 and 1035 (all products of DuPont-Mitsui Polychemicals Co., Ltd.) and ESCOR 5200, 5100 and 5000 (all products of EXXONMOBIL CHEMICAL); and commercial products of the ternary random copolymer include Nucrel AN4311 and AN4318 (all products of DuPont-Mitsui Polychemicals Co., Ltd.) and ESCOR ATX325, ATX320 and ATX310 (all products of EXXONMOBIL CHEMICAL).

Additionally, commercial products of the metal ion-neutralized product of binary random copolymer include Himilan 1554, 1557, 1601, 1605, 1706 and AM7311 (all products of DuPont-Mitsui Polychemicals Co., Ltd.), Surlyn 7930 (E.I. DuPont de Nemours and Company), and Iotek 3110 and 4200 (all products of EXXONMOBIL CHEMICAL); and commercial products of the metal ion-neutralized product of ternary random copolymer include Himilan 1855, 1856 and AM7316 (all products of DuPont-Mitsui Polychemicals Co., Ltd.), Surlyn 6320, 8320, 9320 and 8120 (E.I. DuPont de Nemours and Company), and Iotek 7510 and 7520 (all products of EXXONMOBIL CHEMICAL). Examples of the zinc neutralized ionomer resins which are preferred among the metal ion-neutralized products of random copolymers include Himilan 1706, 1557 and AM7316.

In component (b), the polyolefin component may be selected from low-density polyethylene (LDPE), high-density polyethylene (HDPE), polypropylene, polystyrene and the like. Of these, polyethylene, especially low-density polyethylene having high crystallinity is preferred.

For the polyamide component, use may be made of nylon 6, nylon 66, nylon 11, nylon 12, nylon 610, nylon 612, copolymerized nylon, nylon MXD6, nylon 46, aramid, polyamide-imide, polyimide and the like. Nylon 6 is preferred from a balance of physical properties and cost. The polyamide component preferably takes the form of fibers, with nylon fibers being especially preferred. It is preferred that the nylon fibers have an average diameter of up to 10 μm, more preferably up to 5 μm, even more preferably up to 1 μm, but at least 0.01 μm because better reinforcement effects are developed for a certain amount blended. It is noted that the average diameter is a measurement from observation of a sample cross-section under a transmission electron microscope.

The preferred form of component (b) in the invention is a crystalline polyolefin component bound to surfaces of nylon fibers. As used herein, the term "bound" means that the polyamide and polyolefin components are graft linked by adding a binder. The binders used herein include silane coupling agents, titanate coupling agents, unsaturated carboxylic acids, unsaturated carboxylic acid derivatives, organic peroxides and the like.

In component (b), polyolefin component (b-1) and polyamide component (b-2) are preferably blended in a weight ratio (b-1)/(b-2) between 25/75 and 95/5, more preferably between 30/70 and 90/10, and even more preferably between 40/60 and 75/25. Too little polyamide component fails to exert sufficient reinforcing effects. Too much polyamide component makes it difficult to mix with component (a) during kneading on a twin screw extruder or the like.

Also, components (a) and (b) are preferably blended in a weight ratio ( a)/(b) between 100/0.1 and 100/50, more preferably between 100/1 and 100/40, even more preferably between 100/2 and 100/30. Too less a blending amount fails to exert sufficient effects. Too much a blending amount interferes with kneading or molding into a golf ball cover.

The temperature at which components (a) and (b) are kneaded is preferably equal to or higher than the melting point of polyolefin component, more preferably at least 10° C. higher than the melting point of polyolefin component, and equal to or lower than the melting point of the polyamide component, more preferably at least 10° C. lower than the melting point of polyamide component, in order to maintain the shape of polyamide component as intact as possible. However, the kneading temperature is not necessarily limited to this range.

The temperature of the resin when molded into a golf ball is also preferably in the above-defined temperature range, but may be higher if necessary.

In the resin composition comprising components (a) and (b) as essential components, various additives may be blended in addition to the resin components, if necessary. Such additives include, for example, pigments, dispersants, antioxidants, UV absorbers, UV stabilizers, parting agents, plasticizers, and inorganic fillers (zinc oxide, barium sulfate, titanium dioxide, etc.). It is preferred that components (a) and (b) be included in a total amount of at least 30% by weight, especially 60 to 100% by weight in the resin composition in order to achieve the desired effects of the invention.

It is desired that the cover formed using the resin composition have a Shore D hardness of 55 to 65, preferably 57 to 63, and more preferably 59 to 61. If the Shore D hardness of the cover is too low, rebound becomes poor, with short flight. If the Shore D hardness of the cover is too high, durability to cracking by repeated impact may be exacerbated. It is noted that the Shore D hardness of the cover is a measurement by a type D durometer according to ASTM D2240.

Also, with respect to the gage of the cover, the upper limit is 1.7 mm, preferably 1.6 mm and more preferably 1.5 mm. Beyond the upper limit, the spin rate of the ball when hit with a driver (W#1) may not be suppressed, failing to travel a distance. The lower limit of the cover gage is 0.5 mm, preferably 1.0 mm, and more preferably 1.3 mm. Below the lower limit, durability to cracking by repeated impact may be exacerbated.

In the practice of the invention, the cover resin composition should have a melt flow rate of at least 3, preferably at least 4, more preferably at least 4.5, as measured according to JIS K7210 (1999). If the melt flow rate of the cover resin composition is below the lower limit, the permeation of molten resin through the mold cavity during injection molding may be impeded, resulting in molding defects. Also, the cover resin composition should have a melt flow rate of up to 20, preferably up to 15, more preferably up to 10, as measured according to JIS K7210 (1999). If the melt flow rate of the cover resin composition is beyond the upper limit, burrs are likely to form around support pins and venting pins, also resulting in molding defects. It is noted that the measurement according to JIS K7210 (1999) indicates a melt flow rate of the cover resin composition as measured under conditions: test temperature 190° C. and test load 21.2 N (2.16 kgf).

The golf balls of the invention for competition use are in accord with the Rules of Golf and typically formed to a diameter of 42.60 to 42.80 mm and a weight of 45.0 to 45.93 g.

EXAMPLE

Examples and Comparative Examples are shown below for illustrating the invention, but the invention is not limited to the Examples.

Examples and Comparative Examples

Using the core formulation and vulcanizing method shown in Table 1, solid cores were prepared in Examples and Comparative Examples. The solid core of each Example was determined for an amount of compressive deflection incurred when the applied load was increased from an initial load of 10 kgf to a final load of 130 kgf.

TABLE 1

| | | Example 1 | Example 2 | Comparative Example 1 | Comparative Example 2 | Comparative Example 3 |
|---|---|---|---|---|---|---|
| Core formulation (pbw) | Polybutadiene A*1 | 50 | 50 | 50 | 50 | 50 |
| | Polybutadiene B*2 | 50 | 50 | 50 | 50 | 50 |
| | Zinc acrylate | 25 | 22.2 | 25 | 22.2 | 30 |
| | Organic peroxide-1*3 | 0.6 | 0.6 | 0.6 | 0.6 | 0.6 |
| | Organic peroxide-2*4 | 0.6 | 0.6 | 0.6 | 0.6 | 0.6 |
| | Antioxidant*5 | 0.1 | 0.1 | 0.1 | 0.1 | 0.1 |
| | Zinc oxide | 19.9 | 21.1 | 23 | 19.9 | 17.9 |
| | Zinc salt of pentachlorothiophenol | 0.2 | 0.2 | 0.2 | 0.2 | 0 |
| Core hardness | Surface hardness (Shore D) | 47 | 42 | 47 | 42 | 57 |
| | Center hardness (Shore D) | 37 | 35 | 37 | 35 | 41 |
| | Hardness difference (Shore D) | 10 | 7 | 10 | 7 | 16 |
| Vulcanization (temp./time) | | 160° C./ 15 min | 160° C./ 15 min | 160° C./ 15 min | 160° C./ 15 min | 160° C./ 15 min |

Note:

*1Polybutadiene: BR01 (Ni catalyst), by JSR Corp.

*2Polybutadiene: BR730 (Nd catalyst), by JSR Corp.

*3Organic peroxide-1: dicumyl peroxide, Percumil D (trade name, by NOF Corp.)

*4Organic peroxide-2: 1,1-bis(t-butylperoxy)-3,3,5-trimethylcyclohexane, Perhexa 3M-40 (trade name, by NOF Corp.)

*5antioxidant: Nocrac NS-6 (trade name, by Ouchi Shinko Chemical Industry Co., Ltd.)

Next, the solid core of each Example or Comparative Example was enclosed with a cover made of a cover resin composition of formulation A to C in Table 2 and having a predetermined gage, obtaining a two-piece solid golf ball. These balls were examined for moldability, flight performance, feel on impact, and durability to repeated impact by the tests described below. The results are shown in Table 3.

TABLE 2

| Component (pbw) | A | B | C |
|---|---|---|---|
| Himilan 1557*1 | 50 | 50 | 50 |
| Himilan 1555*2 | 50 | 50 | — |
| Himilan 1601*3 | — | | 50 |
| Titanium oxide | 2 | 2 | 2 |
| Magnesium stearate | 1 | 1 | 2 |
| Polyolefin/polyamide binary copolymer*4 | 5 | — | — |
| Melt flow rate (MFR)*5 | 4.8 | 5.1 | 2.1 |

Note:

*1Ionomer resin (by Dupont-Mitsui Polychemicals Co., Ltd., Zn-neutralized ionomer)

*2Ionomer resin (by Dupont-Mitsui Polychemicals Co., Ltd., Na-neutralized ionomer)

*3Ionomer resin (by Dupont-Mitsui Polychemicals Co., Ltd., Na-neutralized ionomer)

*4LA0010 by Yamato Polymer Co., Ltd., polyolefin (low-density polyethylene)/polyamide (nylon 6) ratio = 100/100 in weight ratio

*5melt flow rate of material as measured according to JIS K7210 (1999), that is, under conditions: test temperature 190° C. and test load 21.2 N (2.16 kgf).

Moldability

In the step of enclosing the core with the cover by injection molding, it was examined how smoothly the cover resin composition permeated through the mold cavity. Specifically, moldability was judged by whether or not weld lines were visually inspected near the vents.

○: When 100 balls were molded, the number of balls on which weld lines were visually inspected was 10 or less.

X: When 100 balls were molded, the number of balls on which weld lines were visually inspected was 16 or more.

Flight Performance

Using a hitting robot equipped with a club, each ball was hit at a head speed of 30 m/s and a total travel distance was measured. The total travel distance was an average computed from the distances of 10 balls.

○: total distance equal to or more than 120 m

X: total distance less than 120 m

Feel

Ten amateur golfers who swing a driver (W#1) at a head speed of 30 to 35 m/s examined the feel of the ball when hit with W#1. The ball was evaluated according to the following criterion.

○: 7 or more of ten golfers ascertained a soft good feel

X: 7 or more of ten golfers ascertained a hard feel

Durability to Repeated Impact

The ball was repeatedly hit at a head speed of 35 m/s. The number of hits when the ball started cracking was counted and reported as an index based on a number of hits of 100 for Comparative Example 2.

○: index equal to or more than 100

X: index equal to or less than 90

TABLE 3

| | | Example 1 | Example 2 | Comparative Example 1 | Comparative Example 2 | Comparative Example 3 |
|---|---|---|---|---|---|---|
| Cover | Material | A | A | B | C | A |
| | Shore D hardness in sheet | 60 | 60 | 60 | 60 | 60 |
| | Gage (mm) | 1.5 | 1.5 | 2.3 | 1.5 | 1.5 |
| Core | Outer diameter (mm) | 39.7 | 39.7 | 38.1 | 39.7 | 39.7 |
| | Hardness (10–130 kgf) (mm) | 3.9 | 4.4 | 3.9 | 4.4 | 3.0 |
| Ball | Outer diameter (mm) | 42.7 | 42.7 | 42.7 | 42.7 | 42.7 |
| | Weight (g) | 45.5 | 45.5 | 45.5 | 45.5 | 45.5 |
| Moldability | | ○ | ○ | ○ | X | ○ |
| Flight performance | Spin (rpm) | 3647 | 3548 | 3757 | 3555 | 3825 |
| | Total (m) | 120.2 | 121.9 | 119.1 | 121.3 | 117.9 |
| | Rating | ○ | ○ | X | ○ | X |
| Feel | | ○ | ○ | ○ | ○ | X |
| Durability to repeated impact (index) | | 121 | 100 | 145 | 85 | 173 |
| | | ○ | ○ | ○ | X | ○ |

It is seen from the results of Table 3 that the golf balls of Examples have a soft feel, offer superior flight performance when golf players with a low head speed of 35 m/s or less play, and are improved in durability to repeated impact and moldability.

By contrast, the ball of Comparative Example 1, which has a thick cover, receives too much spin when hit with the driver (W#1) and loses distance. In Comparative Example 2, the cover resin composition has a poor flow and is difficult to mold into a cover. Since a binary copolymer consisting of polyolefin and polyamide components is not added to the cover, the cover is less durable to repeated impact. Comparative Example 3, in which the core has a high hardness, receives a too much spin rate when hit with the driver (W#1), failing to travel a distance, and the feel is hard.

The invention claimed is:

1. A golf ball comprising a core and a cover formed of a cover resin composition, wherein said core has a hardness corresponding to a compressive deflection amount of at least 3.5 mm when the load applied thereto is increased from an initial load of 10 kgf to a final load of 130 kgf, said cover resin composition has a melt flow rate of at least 3 as measured according to JIS K7210, and said cover has a gage of up to 1.7 mm, and wherein said cover resin composition comprises (a) at least one component selected from the group consisting of olefin-unsaturated carboxylic acid copolymers, olefin-unsaturated carboxylic acid-unsaturated carboxylic acid ester copolymers, and metal ion-neutralized products of these copolymers and (b) a binary copolymer consisting of polyolefin and polyamide components in admixture as a resin component.

2. The golf ball of claim 1, wherein said core has a hardness at its center of 28 to 40 in Shore D hardness and a hardness at its surface of 35 to 52 in Shore D hardness, and the difference in hardness between the core surface and the core center is 3 to 20.

3. The golf ball of claim 1, wherein said cover resin composition has organic short fibers dispersed and incorporated therein.

4. The golf ball of claim 1, wherein the polyamide in component (b) is in fiber form.

5. The golf ball of claim 1, wherein a weight ratio of (a)/(b) is between 100/0.1 and 100/50.

6. The golf ball of claim 1, wherein in component (b), a weight ratio of polyolefinlpolyamide components is between 25/75 and 95/5.

7. A golf ball comprising a core and a cover formed of a cover resin composition, wherein said core is formed of a rubber composition containing polybutadiene synthesized with a rare-earth catalyst as base rubber, and the core has a hardness corresponding to a compressive deflection amount of at least 3.5 mm when the load applied thereto is increased from an initial load of 10 kgf to a final load of 130 kgf, said cover resin composition has a melt flow rate of at least 3 as measured according to JIS K7210, and said cover has a gage of up to 1.7 mm.

8. The golf ball of claim 7, wherein said cover has a Shore D hardness of 59 to 61.

9. The golf ball of claim 7, wherein said core contains an organosulfur compound or organosulfur compounds.

10. The golf ball of claim 9, wherein said organosulfur compounds include thiophenols, thionaphthols, halogenated thiophenols, and metal salts thereof.

11. A golf ball comprising a core and a cover formed of a cover resin composition, wherein said core has a hardness corresponding to a compressive deflection amount of at least 3.5 mm when the load applied thereto is increased from an initial load of 10 kgf to a final load of 130 kgf, said cover resin composition has a melt flow rate of at least 3 as measured according to JIS K7210, and said cover has a gage of up to 1.7 mm and a Shore D hardness of 59 to 61.

12. The golf ball of claim 11, wherein said core contains an organosulfur compound or organosulfur compounds.

13. The golf ball of claim 12, wherein said organosulfur compounds include thiophenols, thionaphthols, halogenated thiophenols, and metal salts thereof.

* * * * *